US005628649A

United States Patent [19]

Yagi et al.

[11] Patent Number: 5,628,649

[45] Date of Patent: May 13, 1997

[54] LOCK DETECTING STRUCTURE OF CONNECTOR

[75] Inventors: Sakai Yagi; Masanori Tsuji; Keishi Jinno, all of Shizuoka-ken, Japan

[73] Assignee: Yazaki Corporation, Tokyo, Japan

[21] Appl. No.: 443,752

[22] Filed: May 18, 1995

[30] Foreign Application Priority Data

Jun. 3, 1994 [JP] Japan ..... 6-122483

[51] Int. Cl.[6] ..... H01R 3/00

[52] U.S. Cl. ..... 439/489; 439/354

[58] Field of Search ..... 439/345, 350–358, 439/488, 489

[56] References Cited

U.S. PATENT DOCUMENTS

| | | | |
|---|---|---|---|
| 4,867,699 | 9/1989 | Oda et al. | 439/489 X |
| 5,127,847 | 7/1992 | Kato et al. | 439/489 |
| 5,203,719 | 4/1993 | Kozono | 439/489 |
| 5,330,369 | 7/1994 | Nozaki et al. | 439/489 |

FOREIGN PATENT DOCUMENTS 3-285280 12/1991 Japan .

*Primary Examiner*—Khiem Nguyen
*Attorney, Agent, or Firm*—Finnegan, Henderson, Farabow, Garrett & Dunner, L.L.P.

[57] ABSTRACT

A lock detecting structure of connector comprises: a male connector housing (100) formed with a deformable lock arm (105) having a lock projection (112), and with two slider stoppers (150); a female connector housing (200) mated with the male connector housing (100) and formed with a lock claw (210) engaged with the lock projection of the male connector housing, and a slider release projection (206); and a slider (300) slidable inserted into the male connector housing (100) and stopped at a temporary engage position due to engagement of the slider with the lock projection (112) and the two slider stoppers (150) of the male connector housing. When the male connector housing (200) is perfectly mated with the female connector housing (100) and thereby the slider is deformed inward away from the lock projection (112) and the slider stoppers (150) of the male connector housing by the lock claw (210) and the slider release projection (206) of the female connector housing (200), the slider can be further inserted deep into the female connector housing (200) to a lock confirmation position. In particular, since the two slider stoppers (150) are formed inside the male connector housing and therefore the slider can be stopped within the male connector housing, it is possible to reliably detect the connector housing lock conditions, without being subjected to the influence of an external force applied to the slider.

7 Claims, 9 Drawing Sheets

LOCK DETECTING STRUCTURE OF CONNECTOR

BACKGROUND OF THE INVENTION

1. Technical Field

The present invention relates to a lock detecting structure of connector suitable for use as a connector for connecting harness wires of an automotive vehicle, for instance, by which a firm connector locking state can be detected firmly.

2. Description of the Related Art

In the case of the connector used for an air bag system of an automotive vehicle, for instance, it is particularly important to severely check whether two mated connector housings have been mated further locked with each other firmly.

An example of the lock detecting structure of connector is disclosed in Japanese Published Unexamined Patent Application No. 285280. In this disclosed connector, the connector is roughly composed of a male connector, a female connector, and a slider having a lock detecting arm. In use of this connector, the slider is previously inserted into the male connector housing, and after that the male connector housing having the slider therein is mated with the female connector housing. In this case, only when the male and female connector housings have been locked perfectly and firmly, since the lock detecting arm of the slider can be released from the male connector housing, the slider can be further inserted deep into the female connector housing, so that it is possible to confirm that the two mated connector housings have been locked securely on the basis of the movable state of the slider.

In the prior art connector having lock detecting structure, however, since the slider is stopped by the male connector housing by use of only a single slider stopper and further since the lock detecting arm of the slider is attached to the outside surface of the connector housing, in case the slider is moved by an external force inadvertently, there exists a problem in that the slider is inclined so that the locking area of the lock detecting arm is reduced, with the result that the slider is moved, in spite of the fact that the two mated connectors are not yet firmly mated with each other. In other words, the connector lock condition cannot be detected reliably.

SUMMARY OF THE INVENTION

With these problems in mind, therefore, it is the object of the present invention to provide a lock detecting structure of connector, which can reliably detect the lock condition of two connector housings by use of a slider having two lock detecting arms and provided within one of the two mated connector housings.

To achieve the above-mentioned object, the present invention provides a lock detecting structure of connector, comprising: a first connector housing (100) formed with a deformable lock arm (105) having a lock projection (112), and with at least one slider stopper (150) inside said first connector housing; a second connector housing (200) mated with said first connector housing (100) and formed with a lock claw (210) engaged with the lock projection of said first connector housing, and a slider release projection (206) inside said second connector housing; a slider (300) slidable inserted into said first connector housing (100) and stopped at a temporary engage position due to engagement of said slider with the lock projection (112) and the slider stopper (150) of said first connector housing; and when said second connector housing (200) is perfectly mated with said first connector housing (100) and thereby said slider is deformed inward away from the lock projection (112) and the slider stopper (150) of said first connector housing, respectively by the lock claw (210) and the slider release projection (206) of said second connector housing (200), said slider being further inserted deep into said second connector housing (200) to a lock confirmation position.

Here, slider (300) includes: a first deformable slider arm (340) formed with a first slider lock projection (342) engaged with the lock projection (112) of said first connector housing (100) when said slider is inserted into said first connector housing, and deformed inward by the lock claw (210) of said second connector housing (200) when said first and second connector housings are perfectly mated with each other; and a second deformable slider arm (320) formed with a second slider lock projection (321) engaged with the slider stopper (105) of said first connector housing (100) when said slider is inserted into said second connector housing, and deformed inward by the slider release projection (206) of said second connector housing (200) when said first and second connector housings are perfectly mated with each other.

Further, said first and second deformable slider arms (340, 320) are formed extending in parallel to each other, and the first slider lock projection (342) and the second slider lock projection (321) are formed on two opposite outside surfaces of free ends of said first and second parallel-extending deformable slider arms (340, 320), respectively.

Further, said first and second deformable slider arms (340, 320) are formed extending in parallel to each other, and the first slider projection (342) and the second slider projection (321) are formed being offset away from each other in a longitudinal direction of said first and second deformable slider arms (340, 320).

Further, the lock projection (112) of said first connector housing (100) is formed with a sloping surface (**112*a*) engaged with a sloping surface (210*a*) of the lock claw (210) of said second connector housing (200**) into wedge-like engagement, when said first and second connector housings are mated with each other.

Further, in said first deformable slider arm (840) of said slider (300), the first slider lock projection (342) is formed with at least one sloping surface (**342*b*) engaged with at least one sloping surface (112*b*) of said lock projection (112**) of said first connector housing so that said slider can be engaged with said second connector housing into wedge-like engagement.

Further, in said second deformable slider arm (820) of said slider (300), the second slider lock projection (321) is formed with at least one sloping surface (822) engaged with at least one sloping surface (**150*a*) of the slider stopper (150**) of said first connector housing so that said slider can be engaged with said second connector housing into wedge-like engagement.

Further, in said first deformable slider arm (340) of said slider (300), the first slider lock projection (342) includes: a middle sloping surface (**342*a*) engaged with a middle sloping surface (112*a*) of the lock projection (112); and two side sloping surfaces (342*b*) formed on both sides of the middle sloping surface and engaged with two side sloping surfaces (112*b*) of said lock projection (112**) of said first connector housing so that said slider can be engaged with said second connector housing into wedge-like engagement and further that said engaged slider and first connector housing will not be disengaged from each other in a direction perpendicular to a longitudinal direction of said slider.

Further, in said second deformable slider arm (320) of said slider (300), the second slider lock projection (321) includes: a middle sloping surface (324) engaged with a sloping surface (208*a*) of a guide projection (208) of the slider release projection (206) of said second connector housing; and two side sloping surfaces (322) formed on both sides of the middle sloping surface and engaged with two side sloping surfaces (150*a*) of two slider stoppers (150) of said first connector housing so that said slider can be engaged with said first connector housing into wedge-like engagement.

As described above, in the lock detecting structure of connector according to the present invention, since the slider is formed with two slider arms and since the two slider arms are stopped at the temporary engagement position by two stoppers (the lock projection and the slider stopper) at least one of which is disposed within the male connector housing, it is possible to reliably stop the slider at the temporary engagement position within the male connector housing without being subjected to the influence of an external force applied to the slider, so that the lock detecting reliability can be improved.

Further, since the two slider lock projections are formed on two opposite outside surfaces of the free ends of the first and second parallel-extending deformable slider arms respectively, even if the slider is inclined inadvertently, it is possible to retain the slider at the temporary engagement position securely, so that an erroneous insertion of the slider into the female connector housing can be prevented.

Further, since the two slider lock projections are formed being offset away from each other in the slider arm direction, it is possible to insert the two slider arms into the male connector housing without providing a wasteful space in the male connector housing.

Further, since the slider, the male connector housing, and the female connector housing are all engaged with each other in wedge-like engagement, it is possible to improve the engagement reliability between the two, respectively.

DETAILED DESCRIPTION OF THE EMBODIMENTS

Figure 1:
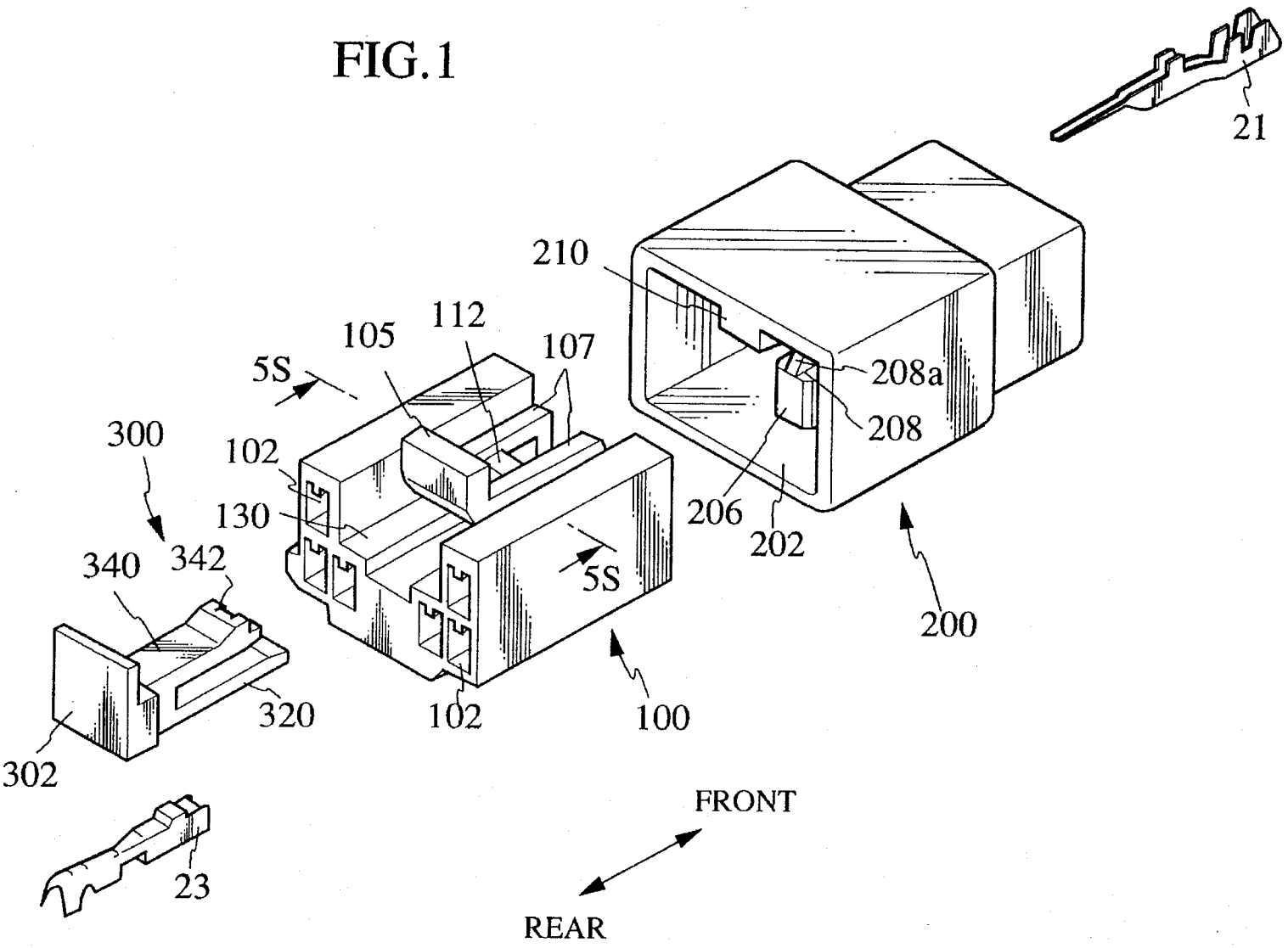
FIG. 1 is a perspective view showing an embodiment of the lock detecting structure of connector according to the present invention.

An embodiment of the lock detecting structure of connector according to the present invention will be described hereinbelow with reference to the attached drawings. The connector is roughly composed of a male connector housing 100, a female connector housing 200, and a slider 300 slidably inserted into the male connector housing 100. A plurality of female terminals 23 are inserted into a plurality of terminal insertion holes 102 of the male connector housing 100, and a plurality of male terminals 21 are inserted into a plurality of terminal insertion holes (not shown) of the female connector housing The male connector housing 100 is formed with a slider accommodating groove 130 for accommodating the slider 300 at the middle portion on the rear side thereof (on the left side in FIG. 1). Further, the terminal insertion holes 102 are formed around the slider accommodating groove 130.

Figure 2:
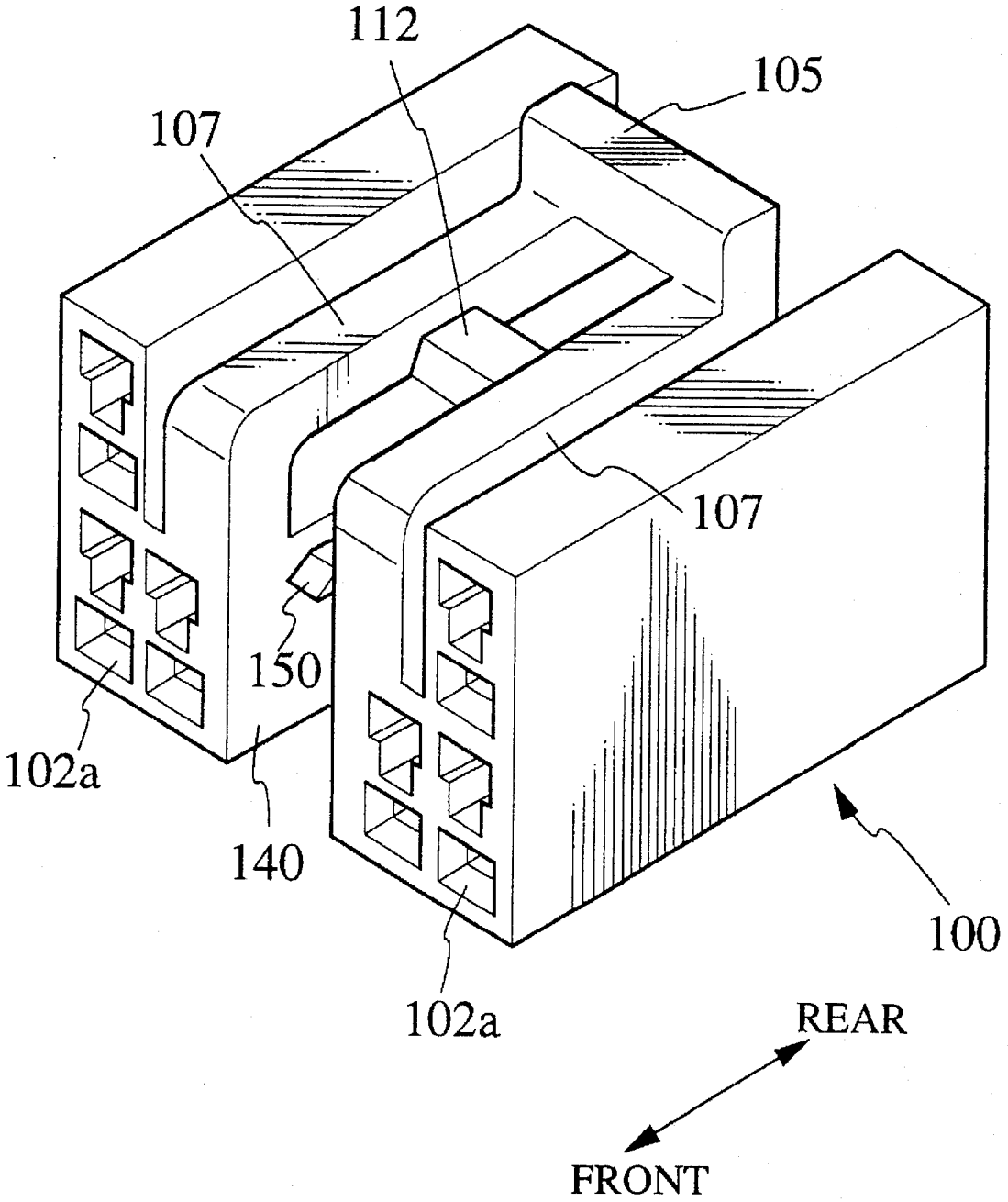
FIG. 2 is a perspective view showing a male connector housing of the embodiment shown in FIG. 1.
Figure 3:
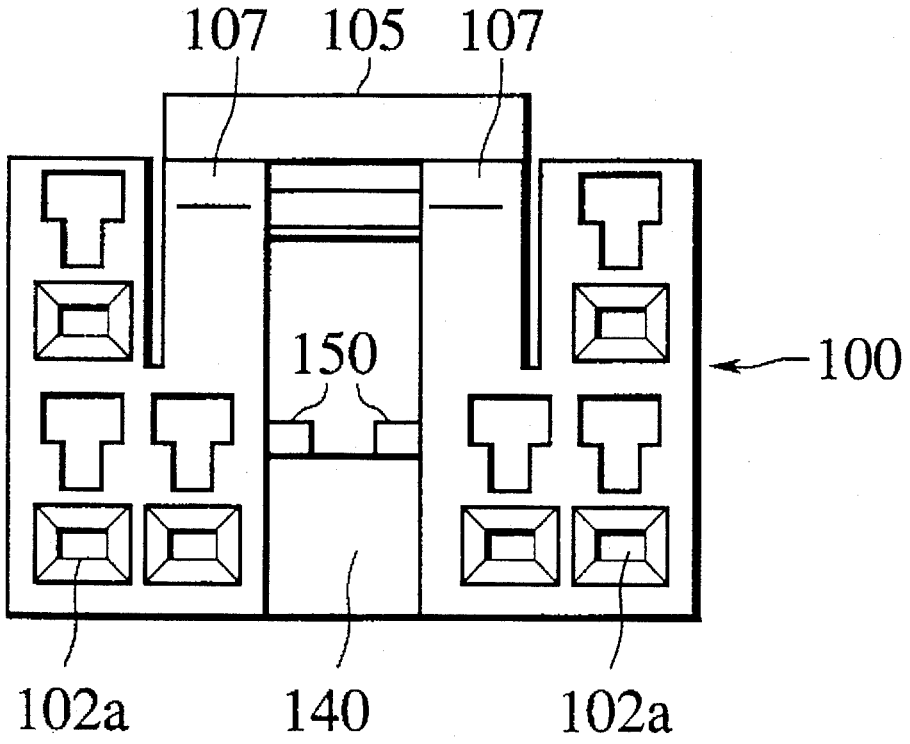
FIG. 3 is a front view showing the male connector housing of the embodiment shown in FIG. 1.

In FIGS. 2 and 3 (in which the male connector housing 100 is seen from the front side), the terminal insertion holes 102 communicate with mate terminal connecting openings 102*a* formed on the front side surface of the male connector housing 100, respectively. Further, the terminal insertion holes 102 are opened on the rear side thereof.

On the upper surface of the male connector housing 100, a deformable lock arm 105 is formed. This deformable lock arm 105 is composed of two parallel arms 107 extending from the front side to the rear side. The two front ends of the parallel arms 107 are formed integral with the front end of the connector housing 100, and supported as two cantilevers. Further, a lock projection 112 for locking the male connector housing 100 with the female connector housing 200 is formed between the two parallel arms 107. This lock projection 112 is also used in common as a slider stopper for stopping a first deformable slider arm 340 (described later) of the slider 300 inserted into the male connector housing 100 to the temporary engagement position.

Further, on the front side of the male connector housing 100, a slider release projection accommodating groove 140 (into which the slider release projection 206 (described later) of the female connector housing 200 is inserted) is formed so as to communicate with the slider accommodating groove 130, as shown in FIGS. 2 and 3. Further, a pair of second slider stoppers 150 for stopping a second deformable slider arm 320 (described later) are formed on both side walls of the groove 140, as shown in FIG. 3. Each second slider stopper 150 is formed with an inclined surface 150*a* at the rear end thereof (See FIG. 6A). Further, a space is formed between the two second slider stoppers 150 so that a guide projection 208 (See FIG. 6A) of the second slider release projection 206 can be inserted therebetween.

Figure 4A:
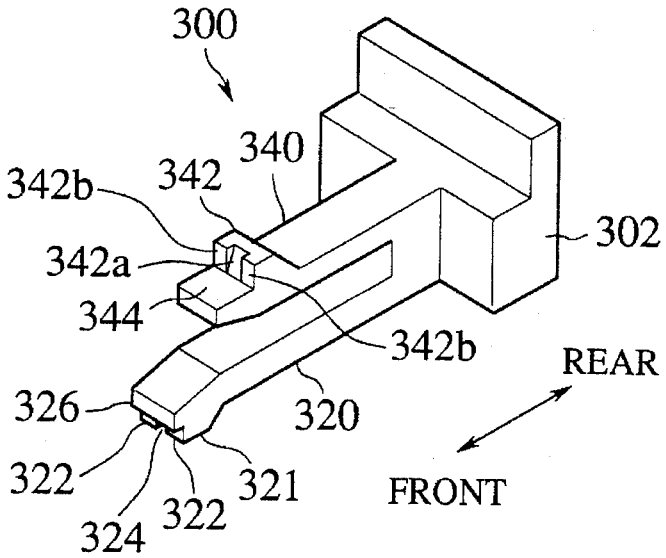
FIG. 4A is a perspective view showing a slider of the embodiment shown in FIG. 1.

As shown in FIG. 4A, the slider 300 is formed with a body portion 302 and two parallel extending first and second deformable slider arms 340 and 320. The length of the first deformable slider arm 340 is shorter than that of the second deformable slider arm 320. A first slider lock projection 342 brought into contact with the lock projection 112 of the male connector housing 100 (See FIG. 6A) is formed on the upper surface of the first deformable slider arm 340. Further, a support wall 344 is formed at the front free end of the first deformable slider arm 340. The first slider lock projection 342 and the support wall 344 are formed in an L-shape when seen from the side thereof.

Figure 4B:
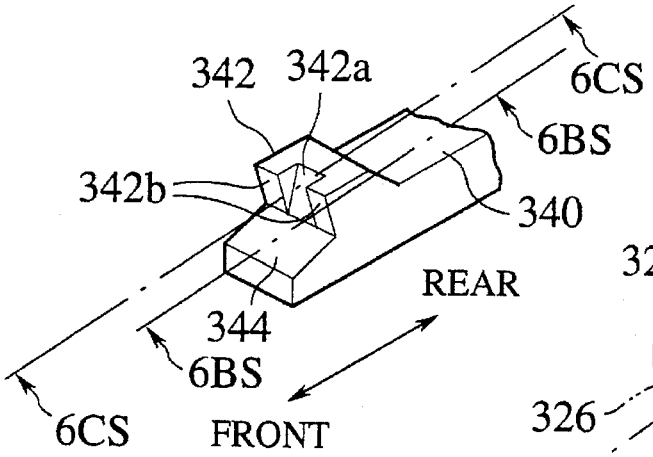
FIG. 4B is an enlarged partial perspective view showing a free end of a first deformable slider arm of the slider of the embodiment shown in FIG. 1.

Further, as shown in FIG. 4B, a middle sloping surface 342*a* is formed at the middle of the front free end surface of the first slider lock projection 342 of the first deformable slider arm 340, and two side sloping surfaces 242*b* are formed on both sides of the front free end surface of the same first slider lock projection 342 thereof. The middle sloping surface 342*a* is formed in such a way that the upper end thereof is inclined rearward from the vertical surface of the slider 300, and the right and left side sloping surfaces 342*b* are formed in such a way that the upper ends thereof are inclined frontward therefrom, so that there exists a stepped (shoulder) portion at the boundary surface between the two middle and side sloping surfaces 342*a* and 342*b*.

Figure 5A:
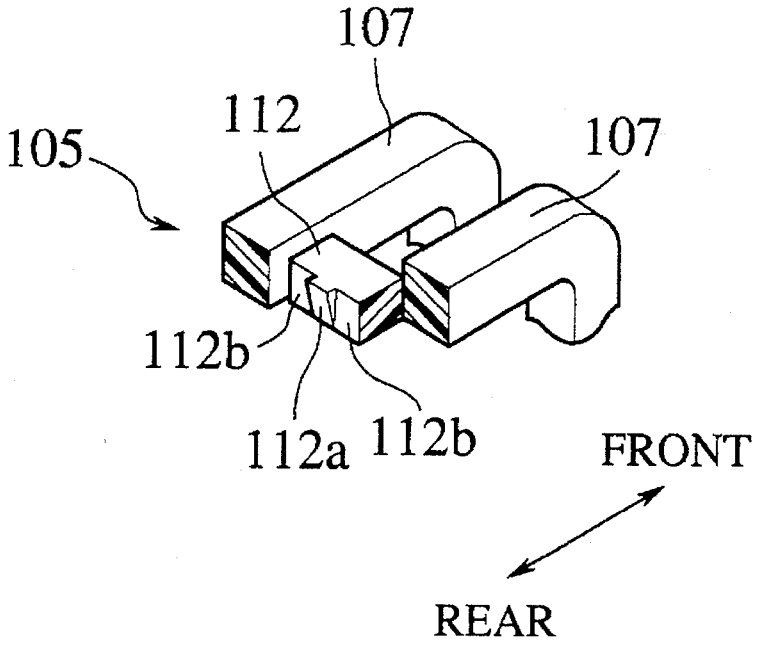
FIG. 5A is a cross-sectional view showing a deformable lock arm of the male connector housing of the embodiment shown in FIG. 1, taken along the line 5S—5S in FIG. 1.
Figure 5B:
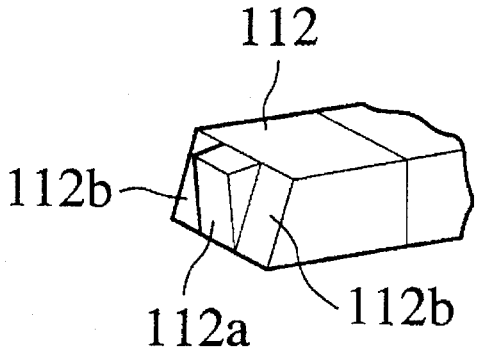
FIG. 5B is an enlarged partial perspective view showing only an end of a lock projection of the male connector housing.

On the other hand, as shown in FIGS. 5A and B, a middle sloping surface 112*a* and right and left side sloping surfaces 112*b* are formed on the end surface of the lock projection 112 of the male connector housing 100 so as to be engaged with the first slider lock projection 342. In more detail, on the rear end surface of the lock projection 112 of the male connector housing 100, the middle sloping surface 112*a* is formed in such a way that the upper end thereof is inclined rearward from the vertical surface of tile lock projection 112, and the right and left side sloping surfaces 112*b* are formed in such a way that the upper ends thereof are inclined frontward therefrom.

In the same way, the second deformable slider arm 320 is formed with a support wall 326 and a second slider lock projection 321. The second slider lock projection 321 is formed on the lower surface of the second deformable slider arm 320 so as to be engaged with the two slider stoppers 150 of the male connector housing 100. Further, the support wall 326 is formed at the front free end of the second deformable slider arm 320. The second slider lock projection 321 and the support wall 326 are formed into an L-shape when seen from the side thereof.

Figure 4C:
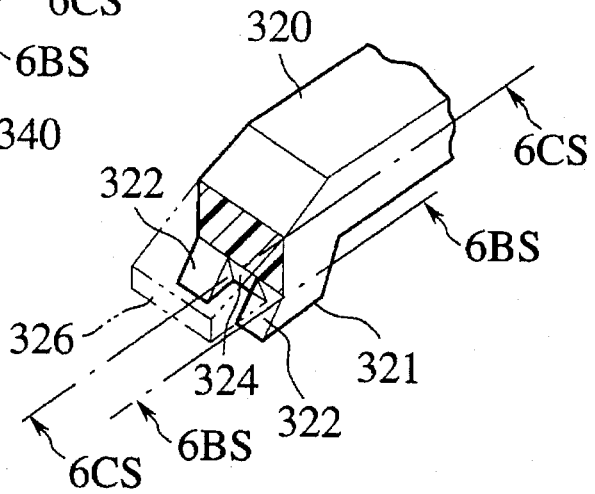
FIG. 4C is an enlarged partial perspective view showing a free end of a second deformable slider arm of the slider of the embodiment shown in FIG. 1.

Further, as shown in FIG. 4C, a middle sloping surface 324 is formed at the middle of the front free end surface of the second slider lock projection 321 of the second deformable slider arm 320, and two other right and left side sloping surfaces 322 are formed on both sides of the front free end surface of the same second slider lock projection 321 thereof. The middle sloping surface 324 is formed in such a way that the upper end thereof is inclined frontward from the vertical surface of the slider 300, and the right and left side sloping surfaces 322 are formed in such a way that the upper ends thereof are inclined rearward therefrom, so that there exists a stepped (shoulder) portion at the boundary surface between the two middle and side sloping surfaces 324 and 322.

Figure 6A:
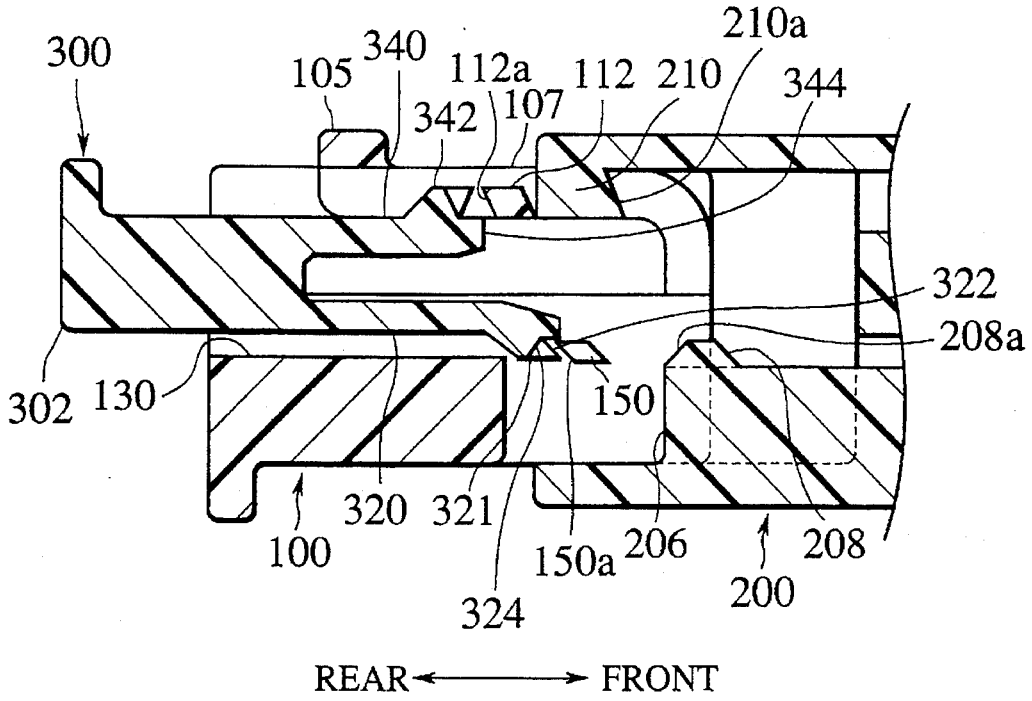
FIG. 6A is a cross-sectional view for assistance in explaining the function of the connector according to the present invention, showing the slider is imperfectly inserted into the male connector housing.
Figure 6B:
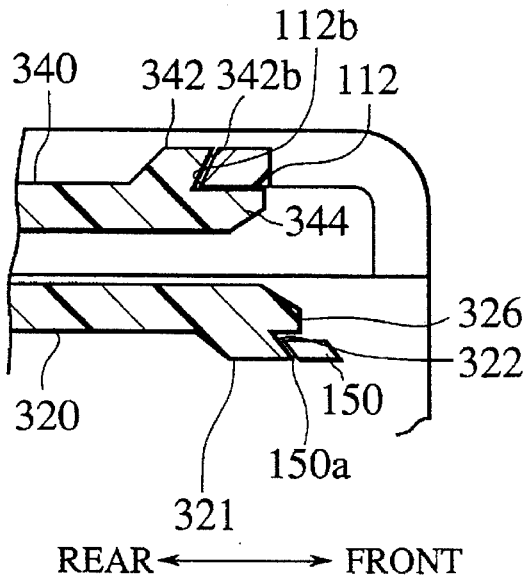
FIG. 6B is a cross-sectional view for assistance in explaining the function of the connector according to the present invention and showing the engagement of two lock projections of the first and second deformable slider arms with two a lock projection and a slider stopper of the male connector housing, taken along the lines 6BS—6BS in FIGS. 4B and C, respectively.

As shown in FIGS. 6B and C, a sloping surface 150*a* is formed on the rear end of each of the slider stoppers 150 of the male connector housing 100 so as to be engaged with the second slider lock projection 321. In more detail, on each rear end surface of the slider stopper 150 of the male connector housing 100, a sloping surface 150*a* is formed in such a way that the upper end thereof is inclined rearward from the vertical surface of each of the slider stoppers 150.

The first slider lock projection 342 and the second slider lock projection 321 are offset in position from each other in the longitudinal direction of the slider 300 according to the difference in length between the two deformable slider arms 340 and 320.

As shown in FIG. 1, the female connector housing 200 has a male connector accommodating chamber 202 for accommodating the male connector housing 100. At the middle portion of the female connector accommodating chamber 202, the second slider release projection 206 is formed extending rearward. This second slider release projection 206 is inserted into the slider release projection accommodating groove 140 formed in the male connector housing 100, as already explained.

The second slider release projection 206 is formed with the guide projection 208 having a guide surface 208*a*. When the guide surface 208*a* of the guide projection 208 is brought into contact with the middle sloping surface 324 formed at the middle of the front free end surface of the second slider lock projection 321 of the second deformable slider arm 320, since the second deformable slider arm 320 is deformed inward, the second slider stopper 150 can be moved further in the frontward direction beyond the second slider stopper 150. The width of the guide projection 208 is determined so as to pass through the space between the two second slider stoppers 150.

Figure 7:
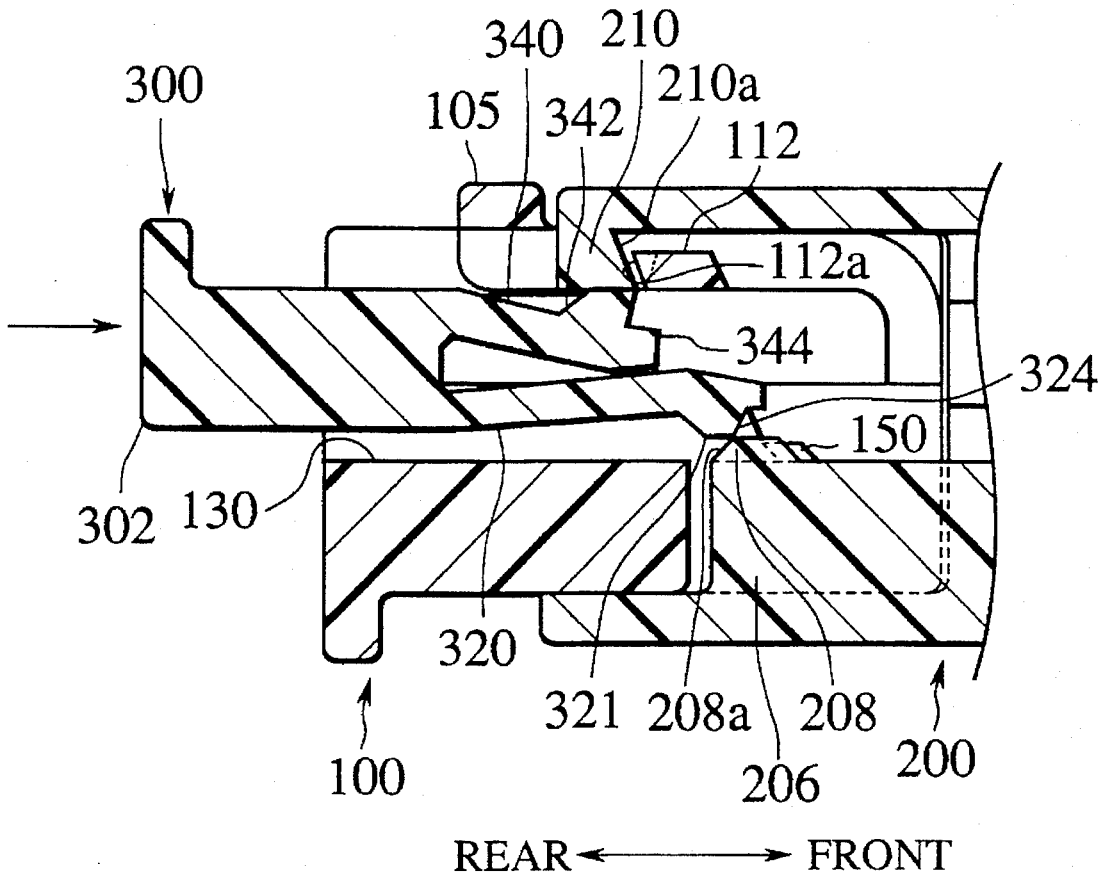
FIG. 7 is a longitudinal cross-sectional view for assistance in explaining the function of the connector according to the present invention, in which the two mated connector housings have been locked perfectly and the slider is not yet moved inward of the male connector housing.

Further, a lock claw 210 is formed on an upper inner surface of the male connector accommodating chamber 202 so as to be engaged with the lock projection 112 of the deformable lock arm 105. Further, as shown in FIG. 7, a lock surface 210*a* is formed on the rear end of the lock claw 210 so as to be engaged with the sloping surface 112*a* of the lock projection 112 of the deformable lock arm 105. This lock claw 210 is used in common as a first slider arm release projection.

The function of the connector according to the present invention will be described hereinbelow with reference to FIGS. 6 to 9.

Prior to the engagement of the male and female connector housings 100 and 200, the slider 300 is first inserted into the slider accommodation groove 130 of the male connector housing 100. Then, as shown in FIG. 6A, since the-first slider lock projection 342 of the first deformable slider arm 340 of the slider 300 is brought into contact with the lock projection 112 of the deformable lock arm 105 of the male connector housing 100, the slider 300 cannot be further inserted into the male connector housing 100. At the same time, since the second slider lock projection 321 formed at the free end of the second deformable slider arm 320 is brought into contact with the slider stoppers 150 of the male connector housing 100, the slider 300 cannot be further inserted into the male connector housing 100. That is, under these conditions, the slider 300 is temporarily engaged with the male connector housing 100 at a temporary engagement position, as shown in FIGS. 6B and C in further enlarged scale.

Figure 6C:
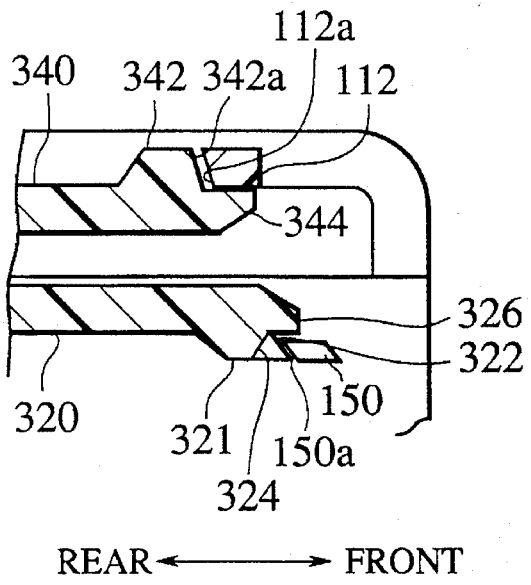
FIG. 6C is a cross-sectional view for assistance in explaining the function of the connector according to the present invention and showing the engagement of two lock projections of the first and second deformable slider arms with the lock projection and the slider stopper of the male connector housing, taken along the lines 6CS—6CS in FIGS. 4B and C, respectively.

In more detail, in FIG. 6B, the two right and left side sloping surfaces 342*b* of the first slider lock projection 342 of the first deformable slider arm 340 are brought into contact with the two right and left side sloping surfaces 112*b* of the lock projection 112 of the male connector housing 100; and further the right and left side sloping surfaces 322 of the second slider lock projection 321 of the second deformable slider arm 320 are brought into contact with the two sloping surfaces 150*a* of the two slider stoppers 150 of the male connector housing 100. Further, as shown in FIG. 6C, the middle sloping surface 342*a* of the first slider lock projection 342 of the first deformable slider arm 340 is brought into contact with the middle sloping surface 112*a* of the lock projection 112 of the male connector housing 100.

Therefore, even if the slider 300 is forcedly inserted into the male connector housing 100, since the lock projection 112 of the male connector housing 100 is engaged with the acute angle portion of the two L-shaped surfaces of the side sloping surfaces 342*b* of the first slider lock projection 342 of the first deformable slier arm 340 in wedge-like engagement, a firm engagement can be established. Further, since the slider stopper 150 of the male connector housing 100 is also engaged with the acute angle portion of the two L-shaped surfaces of the side sloping surfaces 322 of the second slider lock projection 321 of the second deformable slider arm 320 in wedge-like engagement, a firm engagement can be established in the same way. As a result, it is possible to firmly prevent the slider 300 from being inserted into the male connector housing 100 inadvertently and erroneously.

In addition, since the first slider lock projection 342 formed on the upper surface of the first deformable slider arm 340 and the second slider projection 321 formed on the lower surface of the second deformable slider arm 320 are engaged with the lock projection 112 and the slider stopper 150 of the male connector housing 100, respectively, even if an excessive force is applied to the slider 300 and thereby the slider 300 is inclined, any one of the two slider lock projections 342 and 321 can be engaged with any one of the lock projection 112 and the slider stopper 150, with the result that the slider 300 can be securely stopped by the male connector housing 100. Further, in these wedge-like engagements, since the two side sloping surfaces 342*a* and 342*b*; 112*a* and 112*b* of different inclined angles are engaged with each other, it is possible to prevent the engaged slider 300 from being dislocated in the direction perpendicular to the longitudinal direction of the slider 300, so that the slider 300 can be inserted correctly into the male connector housing 100 to a correct temporary engagement position.

Under these conditions, when the female connector housing 200 is mated with the male connector housing 100, as shown in FIG. 7, since lock claw 210 of the female connector housing 200 overrides the lock projection 112 of the deformable lock arm 105 of the male connector housing 100, the male and female connector housings 100 and 200 can be perfectly mated with each other, so that the male terminals 21 and the female terminals 23 can be connected with each other. Under these conditions, since the sloping surface 112*a* (inclined rearward from the top thereof) of the lock projection 112 of the deformable lock arm 105 is engaged with a contact surface 210*a* of the lock claw 210 of the female connector housing 200 in wedge-like engagement, the two connector housings 100 and 200 can be locked firmly with each other. In more detail, when these two connector housings 100 and 200 are pulled away from each other, since the two sloping surfaces 112*a* and 210*a* are engaged further firmly as a wedge function, the two connector housings 100 and 200 can be firmly mated.

Under these conditions, as shown in FIG. 7, since the lock claw 210 of the female connector housing 200 pushes downward or inward the first slider lock projection 342 of the first deformable slider arm 340 of the slider 300, the first deformable slider arm 340 is deformed inward. In the same way, since the guide projection 208 of the slider release projection 206 of the female connector housing 200 pushes upward or inward the second slider lock projection 321 of the second deformable slider arm 320 of the slider 300, the second deformable slider arm 320 is also deformed inward.

Under these conditions that the first and second deformable slider arms 340 and 320 are both deformed inward as shown in FIG. 7, since the two slider lock projections 342 and 321 of the two deformable slider arms 340 and 320 are offset away from each other in the longitudinal direction of the slider 300, even if these two deformable slider arms 340 and 320 are deformed inward, it is possible to prevent these two deformable slider arms 340 and 320 from interfering with each other, even if no large deformation space is formed between the two slider arms within the connector housing 100.

Figure 8:
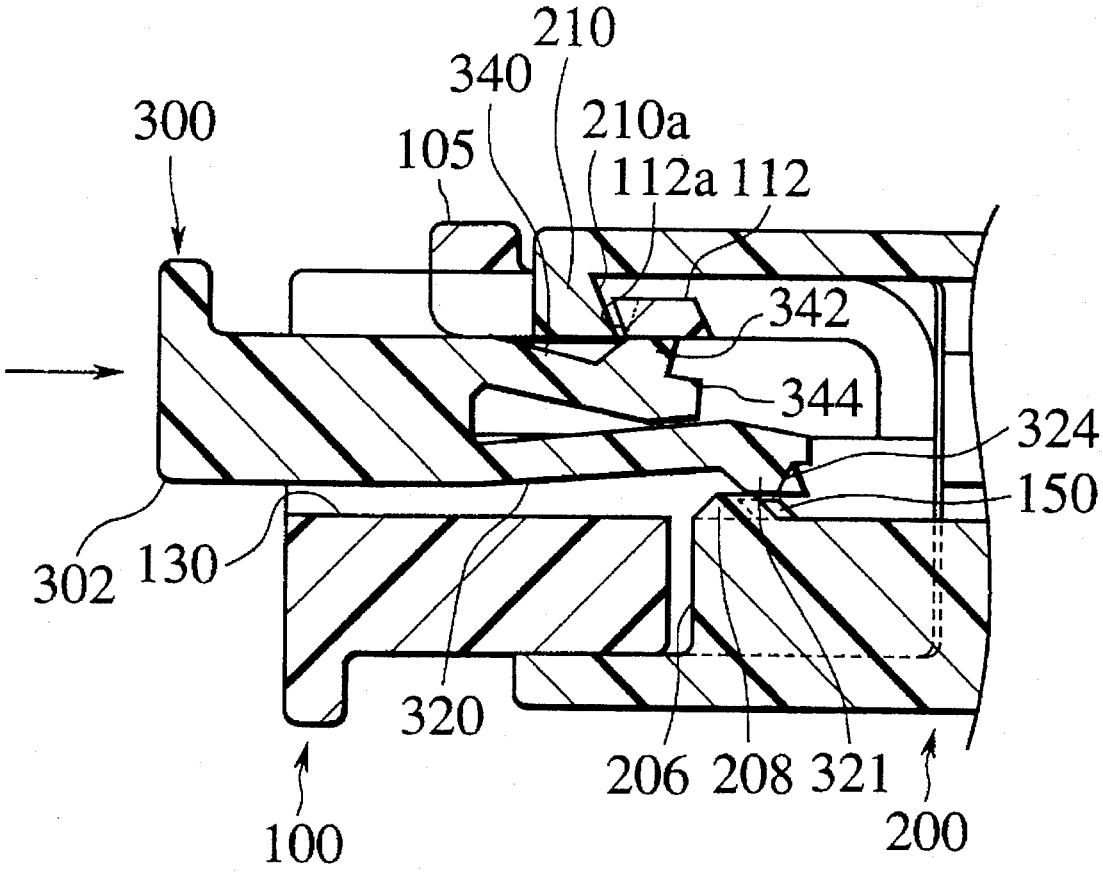
FIG. 8 is a longitudinal cross-sectional view for assistance in explaining the function of the connector according to the present invention, in which the two mated connector housings have been locked perfectly and the slider has been moved inward midway.
Figure 9:
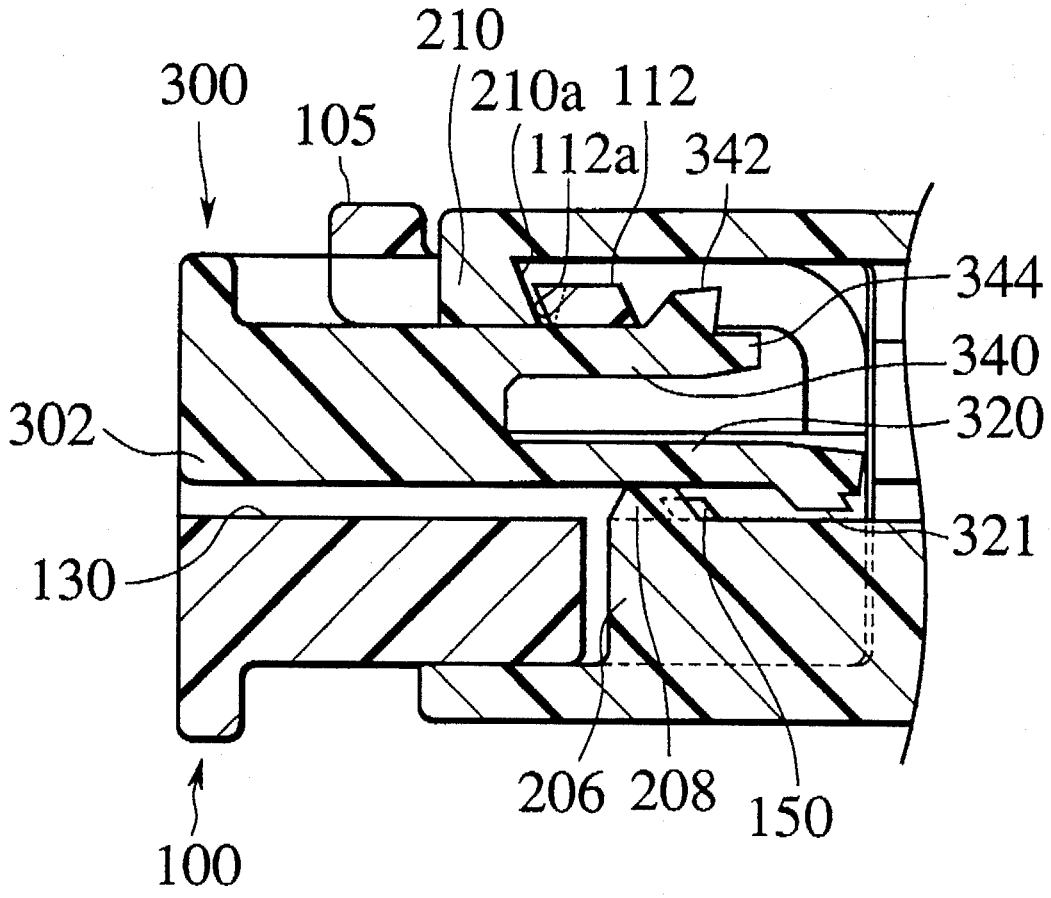
FIG. 9 is a longitudinal cross-sectional view for assistance in explaining the function of the connector according to the present invention, in which the two mated connectors have been locked perfectly and the slider has been moved inward perfectly.

Under these conditions, the slider 300 can be further inserted deep into the male connector housing 100. In more detail, as shown in FIG. 8, the first slider lock projection 342 slides on the inner surface of the lock projection 112 of the male connector housing 100 and the second slider lock projection 321 slides on the inner surface of the slider stopper 150 of the male connector housing 100. Further, as shown in FIG. 9, when the first slider lock projection 342 is located on the front side of the lock projection 112 of the male connector housing 100 and the second slider lock projection 321 is also located on the front side of the slider stopper 150 of the male connector housing 100, the two deformable slider arms 340 and 320 elastically restore to the original positions. Under these conditions, since the first slider lock projection 342 of the slider 300 is locked with the lock projection 112 of the male connector housing 100, the slider 300 is locked with the male connector housing 100 at the lock confirmation position, only after the male and female connector housings 100 and 200 have been mated with each other perfectly.

In the lock detecting structure of connector according to the present invention, when the slider 300 is stopped securely by the lock projection 112 and the slider stopper 150 of the male connector housing 100 at the temporary engagement position, since at least the second deformable slider arm 320 is engaged with the slider stopper 150 inside the male connector housing 100, it is possible to prevent the second deformable slider arm 320 from being moved or dislocated by an external force, so that the slider 300 will not be moved further deep frontward erroneously. In other words, the slider 300 can be stopped at the temporary engagement position firmly.

Further, only when the male and female connector housings 100 and 200 have been perfectly mated with each other and thereby the lock projection 112 and the lock claw 210 are locked with each other firmly, since the slider 300 can be released from the male connector housing 100, the slider 300 can be moved further deep into the female connector housing 200, so that it is possible to confirm the locking conditions of the two male and female connector housings 100 and 200.

Further, since the two slider lock projections 342 and 231 of the two deformable slider arms 340 and 320 are formed in opposing positional relationship with respect to each other, even if the slider 300 is inclined, it is possible to firmly stop the slider 300 within the male connector housing 100 firmly at the temporary engagement position, so that the slider 300 can be prevented from erroneous insertion into the female connector housing 200.

Further, in the above-mentioned embodiment, only when the two slider lock projections 342 and 321 of the two deformable slider arms 340 and 320 of the slider 300 have been perfectly deformed at such positions where the two slider lock projections 342 and 321 will not collide with the lock projection 112 and the slider stoppers 150 of the male connector housing 100, the slider 300 can be further moved deep into the female connector housing 200. However, it is also preferable to provide a slight collision of the two slider lock projections 342 and 321 with the lock projection 112 and the slider stoppers 150 of the male connector housing 100. In this case, it is possible to provide a click feeling to the operator, because the slider 300 is once slightly stopped at the temporary engagement position and then pushed deep into the female connector housing 200 by a stronger slider pushing force.

As described above, in the lock detecting structure of connector according to the present invention, since the slider is formed with two slider arms and since the two slider arms are stopped at the temporary engagement position by two stoppers (the lock projection and the slider stopper) at least one of which is disposed within the male connector housing, it is possible to reliably stop the slider at the temporary engagement position within the male connector housing without being subjected to the influence of an external force applied to the slider, so that the lock detecting reliability can be improved.

Further, since the two slider lock projections are formed on two opposite outside surfaces of the free ends of the First and second parallel-extending deformable slider arms respectively, even if the slider is inclined inadvertently, it is possible to retain the slider at the temporary engagement position securely, so that an erroneous insertion of the slider into the female connector housing can be prevented.

Further, since the two slider lock projections are Formed being offset away from each other in the slider arm direction, it is possible to insert the two slider arms into the male connector housing without providing a wasteful space in the male connector housing.

Further, since the slider, the male connector housing, and the female connector housing are all engaged with each other in wedge-like engagement, it is possible to improve the engagement reliability between the two, respectively.

What is claimed is:

1. A lock detecting structure of connector, comprising:

a first connector housing formed with a deformable lock arm having a lock projection, and with at least one slider stopper inside said first connector housing;

a second connector housing mated with said first connector housing and formed with a lock claw engaged with the lock projection of said first connector housing, and a slider release projection inside said second connector housing;

a slider slidably inserted into said first connector housing and stopped at a temporary engage position due to engagement of said slider with the lock projection and the slider stopper of said first connector housing, said slider including a first deformable slider arm formed with a first slider lock projection engaged with the lock projection of said first connector housing when said slider is inserted into said first connector housing, and deformed inward by the lock claw of said second connector housing when said first and second connector housings are perfectly mated with each other, and said slider including a second deformable slider arm formed with a second slider lock projection engaged with the slider stopper of said first connector housing when said slider is inserted into said second connector housing, and deformed inward by the slider release projection of said second connector housing when said first and second connector housings are perfectly mated with each other; and when said second connector housing is perfectly mated with said first connector housing and thereby said slider is deformed inward away from the lock projection and the slider stopper of said first connector housing, respectively by the lock claw and the slider release projection of said second connector housing, said slider being further inserted deep into said second connector housing to a lock confirmation position.

2. The lock detecting structure of connector of claim 1, wherein said first and second deformable slider arms are formed extending in parallel to each other, and the first slider lock projection and the second slider lock projection are formed on two opposite outside surfaces of free ends of said first and second parallel-extending deformable slider arms, respectively.

3. The lock detecting structure of connector claim 1, wherein said first and second deformable slider arms are formed extending in parallel to each other, and the first slider projection and the second slider projection are formed being offset away from each other in a longitudinal direction of said first and second deformable slider arms.

4. The lock detecting structure of connector of claim 1, wherein in said first deformable slider arm of said slider, the first slider lock projection is formed with at least one sloping surface engaged with at least one sloping surface of said lock projection of said first connector housing so that said slider can be engaged with said second connector housing into wedge-like engagement.

5. The lock detecting structure of connector of claim 1, wherein in said second deformable slider arm of said slider, the second slider lock projection is formed with at least one sloping surface engaged with at least one sloping surface of the slider stopper of said first connector housing so that said slider can be engaged with said second connector housing into wedge-like engagement.

6. The lock detecting structure of connector of claim 1, wherein in said first deformable slider arm of said slider, the first slider lock projection includes:

a middle sloping surface engaged with a middle sloping surface of the lock projection; and two side sloping surfaces formed on both sides of the middle sloping surface and engaged with two side sloping surfaces of said lock projection of said first connector housing so that said slider can be engaged with said second connector housing into wedge-like engagement and further that said engaged slider and first connector housing will not be disengaged from each other in a direction perpendicular to a longitudinal direction of said slider.

7. The lock detecting structure of connector of claim 1, wherein in said second deformable slider arm of said slider, the second slider lock projection includes:

a middle sloping surface engaged with a sloping surface of a guide projection of the slider release projection of said second connector housing; and two side sloping surfaces formed on both sides of the middle sloping surface and engaged with two side sloping surfaces of two slider stoppers of said first connector housing so that said slider can be engaged with said first connector housing into wedge-like engagement.

* * * * *